United States Patent [19]

Kahn

[11] Patent Number: 4,850,020

[45] Date of Patent: Jul. 18, 1989

[54] ASYMMETRICAL SIDEBAND AM STEREO TRANSMISSION

[76] Inventor: Leonard R. Kahn, 137 E. 36th St., New York, N.Y. 10016

[21] Appl. No.: 117,594

[22] Filed: Nov. 5, 1987

[51] Int. Cl.[4] ..... H04H 5/00

[52] U.S. Cl. ..... 381/16

[58] Field of Search ..... 381/1, 2, 3, 4, 15, 381/16, 17, 18, 21, 22, 14

[56] References Cited

U.S. PATENT DOCUMENTS

| | | | |
|---|---|---|---|
| 4,356,349 | 10/1982 | Robinson | 381/1 |
| 4,503,554 | 3/1985 | Davis | 381/1 |
| 4,569,073 | 2/1986 | Kahn | 381/16 |
| 4,589,127 | 5/1986 | Loughlin | 381/16 |
| 4,679,238 | 7/1987 | Markovic et al. | 381/16 |

*Primary Examiner*—Forester W. Isen

*Attorney, Agent, or Firm*—E. A. Onders

[57] ABSTRACT

Asymmetrical sideband amplitude modulation (AM) stereo transmission apparatus which transmits left (L) plus right (R) stereo information (L+R) in one stereo channel and a signal including L−R stereo information in a second stereo channel. Benefits include significant reduction of modulation envelope distortion in null regions of the transmitter's antenna radiation pattern and improved quality of reception in the presence of adjacent channel and co-channel interference, easing of the difficulty in tuning continuously tuned receivers and improvement of the fidelity of such receivers when side tuned, while at the same time providing a signal which, when received and decoded by an independent sideband AM stereo receiver, provides pleasing stereo effects.

15 Claims, 1 Drawing Sheet

ASYMMETRICAL SIDEBAND AM STEREO TRANSMISSION

FIELD OF THE INVENTION

This invention relates to the broadcast of stereophonic program material using asymmetrical sideband amplitude modulation (AM) techniques.

BACKGROUND OF THE INVENTION

Two common problems which accompany the transmission and reception of amplitude modulation (AM) signals are adjacent-channel interference and envelope distortion in null regions of the radiation pattern of an AM transmitter's antenna. These and other problems are alleviated by asymmetrical sideband transmission, which is the subject matter of my prior U.S. Pat. No. 4,569,073.

As shown in my prior patent, one method for implementing asymmetrical sideband AM broadcasting is by using an independent sideband (ISB) AM stereo exciter, which inherently permits independent control of the upper and lower sidebands of an AM signal, preceded by a specialized audio signal processor that determines the relative amplitude and frequency characteristics of the two sets of sidebands in the resulting transmitted signal.

However, asymmetrical sideband transmission in accordance with my prior patent was less suitable for the transmission of stereo program material in that the intentional asymmetry introduced into the sidebands of the transmitted signal also inherently introduced a corresponding asymmetry into the transmitted and received stereo image. For example, if the lower sideband of a transmitted ISB AM stereo signal is enhanced relative to the upper sideband in order to obtain the benefits of asymmetrical sideband transmission, the location of sound sources in the resulting sound image produced by an ISB AM stereo receiver will be correspondingly shifted to the left. This occurs because in the ISB system, the lower sideband carries primarily left (L) stereo information, whereas the upper sideband carries primarily right (R) stereo information.

Because of this, my prior patent proposed that asymmetrical sideband AM transmission be used primarily for broadcasting monophonic program material, and that for stereo program material the transmitter should be switched to normal ISB AM stereo transmission. (See FIG. 3 of that patent).

It is, therefore, an object of the present invention to provide an asymmetrical sideband AM transmission system which not only alleviates the problems of adjacent channel interference and envelope distortion in null regions of a directional antenna's radiation pattern, reduces the effects of co-channel interference, reduces distortion caused by selective fading, eases the difficulty in tuning continuous tuned receivers and improves the fidelity of such receivers when side tunes, but also enables stereo program material to be transmitted and received with pleasing stereo effects on ISB AM stereo receivers.

SUMMARY OF THE INVENTION

In accordance with one aspect of the present invention there is provided signal processing apparatus which includes means for supplying a first pair of signals containing related audio frequency information, and means, responsive to the first pair of signs, for processing such signals to develop therefrom a second pair of signals, one of the second pair containing information representing a processed sum of the first pair of signals and the other of the second pair containing information representing a predetermined combination of a processed sum and a processed difference of the first pair of signals.

In accordance with another aspect of the present invention, there is provided asymmetrical sideband amplitude modulation (AM) stereo transmission apparatus which includes means for supplying a first pair of signals containing related audio frequency information and means, responsive to the first pair of signals, for processing such signals to develop therefrom a second pair of signals, one of the second pair containing information representing a processed sum of the first pair of signals and the other of the second pair containing information representing a predetermined combination of a processed sum and a processed difference of the first pair of signals. The apparatus also includes means, responsive to the second pair of signals, for transmitting such pair substantially as the different asymmetrical sidebands, respectively, of a carrier wave.

In accordance with still another aspect of the present invention, there is provided a method of transmitting an asymmetrical sideband amplitude modulation (AM) stereo signal suitable for reception on independent sideband AM stereo receivers, including the steps of deriving from a supplied pair of left (L) and right (R) stereo signals the sum and the difference thereof, introducing a predetermined phase difference between such sum and difference signals, modifying the frequency spectrum and amplitude level of the phase shifted sum signal in accordance with first and second signal transfer characteristics, modifying the frequency spectrum and amplitude level of the phase shifted difference signal in accordance with a third signal transfer characteristic, combining the phase shifted sum and difference signals, after they have been modified in accordance with the second and third signal transfer characteristics, to form a combined signal, applying to one stereo signal input of an independent sideband (ISB) AM stereo transmitter the phase shifted sum signal after it has been modified in accordance with the first signal transfer characteristic, and applying the combined signal to the other stereo signal input of said ISB AM stereo transmitter.

In accordance with yet another aspect of the invention, there is provided a method of processing a supplied pair of left (L) and right (R) stereo signals to develop a second pair of signals suitable for application to the stereo signal inputs of an independent sideband (ISB) AM stereo transmitter, thereby resulting in the transmission of an asymmetrical sideband amplitude modulation (AM) stereo signal suitable for reception on an ISB AM stereo receiver, including the steps of deriving from said supplied pair of L and R stereo signals the sum and the difference thereof, introducing a predetermined phase difference between the sum and difference signals, modifying the frequency spectrum and amplitude level of the phase shifted sum signal in accordance with first and second signal transfer characteristics, modifying the frequency spectrum and amplitude level of the phase shifted difference signal in accordance with a third signal transfer characteristic, combining the phase shifted sum and difference signals, after they have been modified in accordance with the second and third signal transfer characteristics, to form a combined signal whereby the phase shifted sum signal, after it has been modified in accordance with the first signal transfer characteristic, and the combined signal constitute the second pair of signals.

For a better understanding of the present invention, together with other and further objects thereof, reference is made to the following description taken in conjunction with the accompanying drawings, and its scope will be pointed out in the appended claims.

DESCRIPTION OF THE INVENTION

To facilitate the following description of an asymmetrical sideband AM stereo system according to the present invention, it is assumed that the lower frequency sideband of the transmitted signal is enhanced (made larger in amplitude) relative to the upper frequency sideband, and that the lower sideband represents left (L) stereo information whereas the upper sideband represents right (R) stereo information (consistent with the convention that has been adopted for the allocation of stereo information between the sidebands of the transmitted signal is ISB AM stereo systems). However, these assumptions are not limitations in that the present invention is equally applicable where either or both of the assumed conditions is reversed. That is, where the upper sideband is enhanced instead of the lower, and/or where the upper sideband represents L stereo information instead of R.

Figure 1:
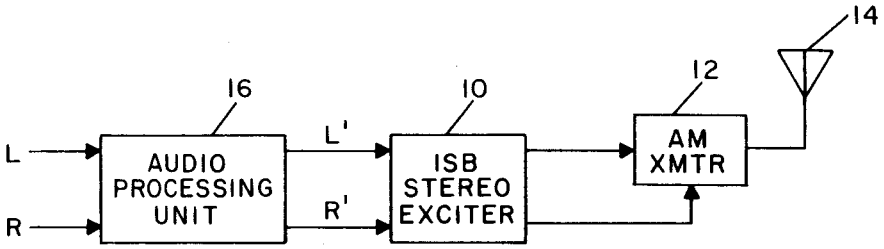
FIG. 1 is a simplified block diagram of an asymmetrical sideband AM stereo transmitter embodying the present invention.

FIG. 1 shows a simplified block diagram of an asymmetrical sideband AM stereo transmitter in accordance with the present invention. It should be noted that ISB stereo exciter 10, AM transmitter 12 and antenna 14 may be the same as the corresponding units 110, 112 and 114 shown in FIG. 1 of my prior U.S. Pat. No. 4,569,073 and described in the specification thereof, which is hereby incorporated herein by reference. The difference, therefore, lies in the contents of audio processing unit 16 shown in FIG. 1 hereof and in greater detail in FIG. 2 hereof.

In FIG. 1, ISB AM stereo exciter 10 may be, for example, a model STR-77 or STR-84 exciter manufactured by Khan Commuications, Inc. of Westbury, New York, while AM transmitter 12 and antenna 14 may be, for example, any of the transmitters and antennas commonly used for commercial AM stereo broadcasting. As noted in the preamble and later in this specification, however, antenna 14 may be a directional transmitting antenna having one or more nulls in its radiation pattern, in which case the asymmetrical sideband nature of the present invention offers an additional advantage in that envelope distortion in such null region, or regions, will be reduced from that which would otherwise be present if symmetrical sideband transmission were used instead of asymmetrical sideband transmission in accordance with my prior U.S. Pat. No. 4,569,073.

In FIG. 1, the L and R inputs to audio processing unit 16 may be coupled directly to any source of stereo signals or to such a source via additional audio processors, such as those conventionally used at AM stations which broadcast stereo programming. Alternatively, during periods of monophonic operation, such as "talk shows" for example, the same monophonic signal may be supplied to the L and R inputs of processor 16, or the monophonic signal may be processed by a commercially available stereo synthesizer and the resulting synthesized L and R signals supplied to the corresponding inputs of processor 16. In all of these cases, the combination of audio processing unit 16, ISB stereo exciter 10, AM transmitter 12 and antenna 14 will operate to produce a transmitted asymmetrical sideband signal containing stereo, synthesized stereo or monophonic information, as the case may be, suitable for reception on an ISB AM stereo receiver with pleasing sounding results.

Figure 2:
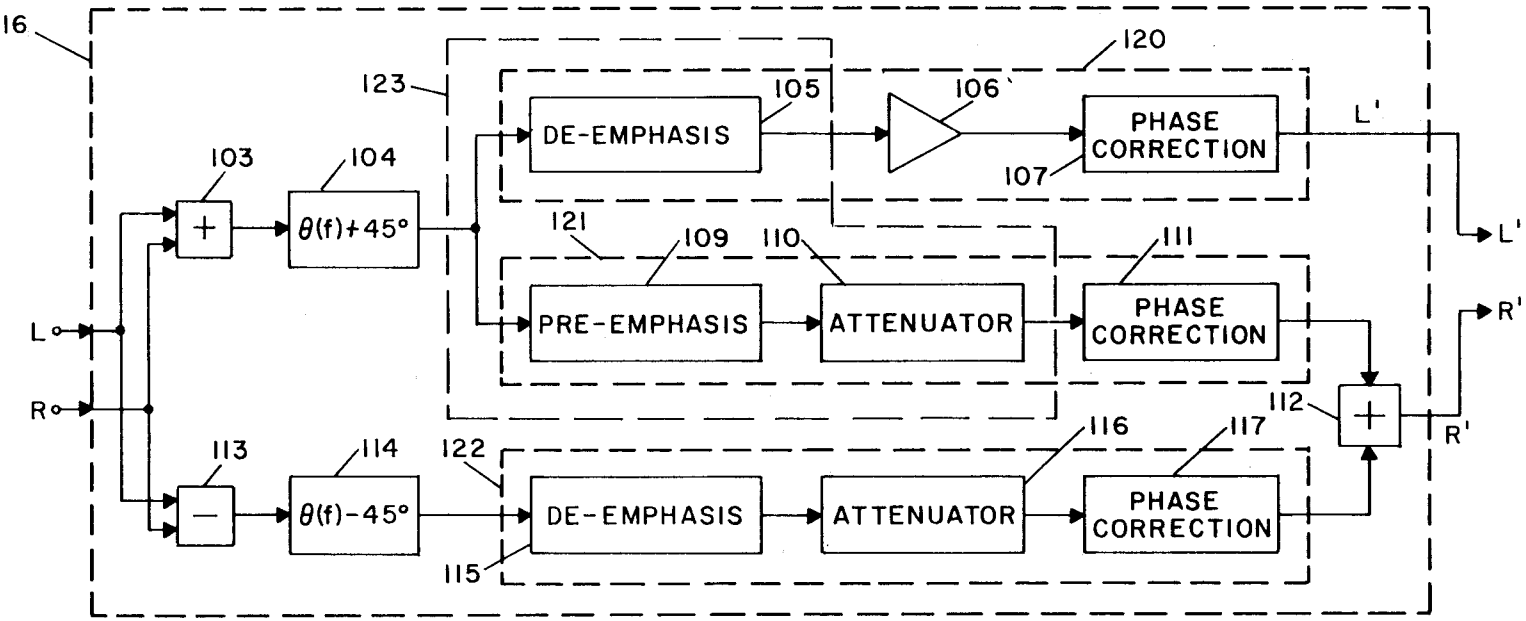
FIG. 2 is a block diagram illustrating one embodiment of the audio processing unit 16 shown in block form in FIG. 1.

Turning now to FIG. 2, there is shown a detailed block diagram of one embodiment of the audio processing unit 16 shown in general form in FIG. 1.

The L and R inputs to processor 16 are coupled to an adder 103 which forms an L+R signal that is coupled to phase-shift network 104. Similarly the L and R inputs are coupled to subtracter 113 which forms an L−R signal that is coupled to phase-shift network 114. Phase-shift networks 104 and 114 provide a substantially constant phase difference of preferrably 90° between their output signals over a wide band of frequencies when signals of the same frequency and phase are applied to their inputs.

Units 104 and 114 may be implemented using all-pass networks with parameters which provide a substantially constant 90° phase difference over a predetermined frequency range. Such networks are well-known, having found frequent application in single-sideband transmitters and in transmitters and receivers for the Kahn/Hazeltine ISB AM stereo system. A typical such network for ISB encoding apparatus exhibits a phase difference of 90° ±1.5° over a frequency range of 95Hz to 9.5kHz. While a phase difference of 90° is preferred, acceptable results may be obtained using other values and over frequency ranges which differ from the example given above.

Although the specific implementation shown in FIG. 2 causes the output of network 114 to lag in phase the output of network 104, the invention would be equally applicable if the plus and minus signs in blocks 104 and 114, respectively, were interchanged. The purposes served by these networks are discussed later in conjunction with the discussion of adder 112.

Returning to phase shift network 104, its output is split and one branch is coupled to first signal translation channel 120. De-emphasis network 105 may be a simple RC combination so connected as to tend to compensate for the high-frequency pre-emphasis normally provided by conventional audio processors which may be used ahead of unit 16 as explained previously. It is possible to provide a de-emphasis circuit that essentially compensates for the pre-emphasis characteristic of such audio processors, resulting in an essentially flat transmission frequency response for the lower sideband of the resulting asymmetrical sideband AM stereo transmitted signal.

The output of de-emphasis network 105 is coupled to the input of amplifier 106, which may have a gain of 4.61dB for example. The gain is selected, in conjunction with the attenuations of units 110 and 116 in second and third signal translation channels 121 and 122, respectively, to retain the full amplitude modulation capability of the AM transmitter with which unit 16 is used. For example, these values may be selected, or adjusted, so that for a full L-only or R-only input signal, first signal translation channel 120 causes 85% amplitude modulation in the transmitted signal whereas second and third signal translation channels 121 and 122 each cause 14%. However, because of the quadrature relationship between channels 121 and 122, the total modulation caused by all three channels will be almost a full 100% for low frequency modulating signals (below 1kHz, for example).

The amplified output of block 106 is then coupled to the input of phase correction circuit 107. Phase correction circuits 107, 111, and 117 in first, second and third signal translation channels 120, 121 and 122, respectively, operate to essentially equalize the high-frequency phase responses of first and second signal translation channels 120 and 121, and to essentially maintain the 90° phase difference between the phase response of third signal translation channel 122 and the other two signal translation channels over a predetermined range of frequencies.

The L′ output of phase correction circuit 107, which is essentially processed L+R information (including phase shifting by network 104), is then supplied to the L input of ISB stereo exciter 10 as shown in FIG. 1 in accordance with the teachings of the invention.

Returning to phase-shift network 104, the second branch of its output is coupled to the input of second signal translation channel 121. The effect of blocks 110 and 109, respectively is to reduce the amount of amplitude modulation produced by the upper sideband of the resulting asymmetrical sideband signal, therefore allowing more room for modulation produced by the lower sideband, and to accentuate the pre-emphasis of the higher frequency components of the upper sideband. The additional pre-emphasis compensates for the reduction or elimination of pre-emphasis provided by the lower sideband components in first signal translation channel 120. The overall desired result is to provide the required pre-emphasis effect when a listener tunes his or her receiver so as to center on the carrier (so called "center tuning"). This is accomplished in such a manner as to also allow listeners to tune off center, so as to favor the lower sideband (so called "side tuning"), thereby reducing the adverse effects from adjacent channel interference above the desired station's assigned carrier frequency.

A typical attenuation for attenuator 110 (when the gain of amplifer 106 is 4.61dB) is 11.06dB, which, as stated previously, retains the full amplitude modulation capability of the transmission system. The apparatus in block 123 follows the teachings of my prior U.S. Pat. No. 4,569,073.

The function of phase-correction circuit 111 has been explained in conjunction with the function of block 107 in first signal translation channel 120. The output of block 111, which is essentially processed L+R information (including phase shifting by network 104), is coupled to a first input of adder 112, which will be discussed in more detail presently.

For ease of adjustment and simplification of construction, the embodiment shown in FIG. 2 may be modified slightly by taking the input to channel 121 from the output of de-emphasis network 105, instead of from phase shift network 104, and by eliminating phase correction circuit 111. With respect to the latter change, those skilled in the art will recognize that the output of channel 121 may serve as the phase reference, so that phase correction circuits 107 and 117 are merely adjusted in relation to this reference instead of providing three phase correction circuits.

Turning now to third signal translation channel 122, the phase shifted L−R signal from network 114 is coupled to the input of de-emphasis network 115. As has been described for de-emphasis network 105, network 115 normally will compensate for pre-emphasis introduced by any audio processors which may be used ahead of unit 16, so as to provide an essentially flat overall frequency response to the output of third signal translation channel 122. Thus, essentially all pre-emphasis in the transmitted signal is provided by second signal translation channel 121.

The attenuation of attenuator 116 is normally essentially the same as for block 110, i.e., 11.06dB. The function of phase correction circuit 117 has already been explained in conjunction with the description of block 107 in first signal translation channel 120.

The output of phase correction circuit 117, which is essentially processed L−R information (including phase shifting by network 114), is coupled to a second input of adder 112. The processed L+R and L−R signals applied to adder 112 are in essentially quadrature phase relationship. The sum of these two signals, labelled R′ in FIG. 2, is supplied to the R input of ISB stereo exciter 10 as shown in FIG. 1 in accordance with the teachings of the invention.

Phase shift networks 104 and 114 alleviate two problems which might occur in their absence. First, when the outputs of second and third signal translation channels 121 and 122 are summed in adder 112, in the absence of the phase shift networks, when the broadcaster switches from monaural to stereo broadcasting, there would be an abrupt increase in modulation percentage due to the algebraic addition of the processed L+R and L−R signals in adder 112. However, due to the presence of phase shift networks 104 and 114, the processed L−R signal is added to the processed L+R signal in quadrature, and instead of a potential 2:1 increase in the output of adder 112 when switching from monaural to stereo, the increase is a potential factor of 1.41. Second, without phase shift networks 104 and 114, at certain audio frequencies, particularly for R-only stereo input signals, a cancellation might occur in adder 112.

With the embodiment of FIG. 2 described above, where the gain of amplifier 106 is 4.61dB, and the attenuations of attenuators 110 and 116 are 11.06dB each, and with a low frequency monaural signal input (i.e. R=L, less than 1kHZ) the sideband amplitudes of the resulting transmitted asymmetrical signal are in the ratio of approximately 6.07 (15.67dB). With an L-only or R-only full stereo input signal, the sideband amplitude ratio is approximately 4.29 (12.6dB).

In order to provide a clue to listeners of the asymmetrical sideband signal using monaural receivers that they should tune toward the sideband away from adjacent channel interference, the perceived loudness should be greater on that side. (It is assumed that the teachings of my prior U.S. Pat. No. 4,569,073 will be followed in assigning the weaker sideband to the side of the carrier which is subject to adjacent-channel interference.) Thus, the effect of pre-emphasis of the weaker sideband should not overcome the increased low frequency gain for the favored sideband. As a compensating effect, a listener will naturally tune away from the harsher sound heard when tuning to the heavily pre-emphasized weaker sideband.

One approach is to make the stronger sideband flat; i.e., no pre-emphasis, and to have the weaker sideband support all of the pre-emphasis, as was described for the embodiment in FIG. 2. In this case the sensitivity to detuning the receiver to the stronger sideband is small. However, the pre-emphasis of the weaker sideband will, at times, have some additional energy over and above the normal energy level. This situation can be alleviated by putting some pre-emphasis in the larger amplitude sideband path. However, the perceived loudness, when tuning toward the lower sideband, should be greater than tuning toward the upper-sideband. This provides the listener with an important clue, causing him or her to favor tuning his or her receiver away from possible adjacent-channel inteference on the weaker sideband side of the carrier.

Furthermore, the harsher sound of the upper sideband, due to the use of greater pre-emphasis, should naturally cause listeners to avoid tuning towards the upper-sideband (assumed for this example to be toward the interference). This is described in greater detail in my prior U.S. Pat. No. 4,569,073 with respect to FIGS. 4–6 thereof.

The amount and character of the pre-emphasis used in practicing the invention is a function of many factors, including the selectivity characteristics of the receivers used, the type of music transmitted, the character and strength of the interference, etc. Therefore, it is expected that a wide variety of pre-emphasis curves will be used by AM radio stations implementing the present invention.

Normally, when stereo sound, such as music, is transmitted in accordance with the present invention, a stereo received would be center-tuned. However, a monaural receiver tuned to the same signal would likely be side tuned toward the stronger sideband, especially if adjacent-channel inteference were present.

As mentioned previously, a reduction in modulation-envelope distortion results from changing an overmodulated symmetric double-sideband signal to an asymmetric sideband signal. For example, if it is assumed that the carrier of a symmetric double sideband signal has been suppressed in an antenna's null region to a level of 0.65 times the sum of the sidebands, the resulting envelope will exhibit a foldover with sharp transitions, which are sources of higher-order harmonics. On the other hand, with an asymmetric sideband signal, corresponding to that developed by the embodiment described for FIG. 2 when a monaural signal is transmited, a much smoother modulation envelope is obtained in the antenna's null region.

The above has been confirmed by field experience (using the Kahn/Hazeltine ISB AM stereo system) which has shown that asymmetric sideband transmission significantly reduces the perceived distortion of signals received in the null region of a transmitter antenna. Of particular importance, for the examples cited, the higher-order distortion is significantly reduced. Since higher-order distortion products are generally more objectionable to listeners than second-harmonic distortion, the subjective improvement in the quality of reception may be more significant than one might expect.

While there has been described what is at present considered to be the preferred embodiment of this invention, it will be obvious to those skilled in the art that various changes and modifications may be made therein without departing from the invention and it is, therefore, aimed to cover all such changes and modifications as fall within the true spirit and scope of the invention.

What is claimed is:

1. Signal processing apparatus, comprising:

means for supplying a first pair of signals containing related audio frequency information; and means, responsive to said first pair of signals, for processing said signals to develop therefrom a second pair of audio frequency signals, one of said second pair containing information representing a processed sum of said first pair of signals and the other of said second pair containing information representing the sum of a processed sum and a processed difference of said first pair of signals, said processed sum and processed difference signals having a substantially quadrature relationship.

2. Apparatus in accordance with claim 1 wherein said first pair of signals is a pair containing left (L) and right (R) stereo information, respectively.

3. Apparatus in accordance with claim 1 wherein said first pair of signals is a pair containing monophonic information.

4. Signal processing apparatus, comprising:

means for supplying a first pair of signals containing related audio frequency information;

means for combining said first pair of signals to form a signal representing the sum thereof;

means for combining said first pair of signals to form a signal representing the difference thereof;

means, responsive to said sum and difference signals, for shifting the relative phase of said signals in accordance with a predetermined phase characteristic;

means for processing said phase shifted sum signal in accordance with a predetermined first signal transfer characteristic to develop one of a second pair of signals;

means for processing said phase shifted sum signal in accordance with a predetermined second signal transfer characteristic to develop a first intermediate signal;

means for processing said phase shifted difference signal in accordance with a predetermined third signal transfer characteristic to develop a second intermediate signal; and means for combining said first and second intermediate signals to develop the other of said second pair of signals.

5. Apparatus in accordance with claim 4 wherein said phase shifting means introduces a relative phase difference of approximately 90° over a predetermined band of frequencies.

6. Apparatus in accordance with claim 5 wherein said first signal transfer characteristic includes modifying the frequency spectrum and amplitude level of said phase shifted sum signal.

7. Apparatus in accordance with claim 5 wherein said first, second and third signal transfer characteristics each includes modifying the frequency spectrum and amplitude level of the respective signals.

8. Apparatus in accordance with claim 7 wherein said first signal transfer characteristic includes de-emphasis and amplification of said phase shifted sum signal, said second signal transfer characteristic includes pre-emphasis and attenuation of said phase shifted sum signal, and said third signal transfer characteristic includes de-emphasis and attenuation of said phase shifted difference signal.

9. Apparatus in accordance with claim 4 wherein the means for combining said first and second intermediate signals adds said signals to develop the other of said second pair of signals.

10. Asymmetrical sideband amplitude modulation (AM) stereo transmission apparatus, comprising:

means for supplying a first pair of signals containing left (L) and right (R) stereo information, respectively;

means for combining said L and R signals to form a signal representing the sum (L+R) thereof;

means for combining said L and R signals to form a signal representing the difference (L−R) thereof;

means, responsive to said sum and difference signals, for shifting the relative phase of said signals in accordance with a predetermined phase characteristic;

means for processing said phase shifted sum signal in accordance with a predetermined first signal transfer characteristic to develop one of a second pair of signals;

means for processing said phase shifted sum signal in accordance with a predetermined second signal transfer characteristic to develop a first intermediate signal;

means for processing said phase shifted difference signal in accordance with a predetermined third signal transfer characteristic to develop a second intermediate signal;

means for combining said first and second intermediate signals to develop the other of said second pair of signals; and means, including an independent sideband AM stereo exciter having a pair of stereo signal inputs to which said second pair of signals are coupled, for transmitting said second pair substantially as the different asymmetrical sidebands, respectively, of a carrier wave.

11. Asymmetrical sideband amplitude modulation (AM) stereo transmission apparatus, comprising:

means for supplying a first pair of signals containing related audio frequency information;

means, responsive to said first pair of signals, for processing said signals to develop therefrom a second pair of signals, one of said second pair containing information representing a processed sum of said first pair of signals and the other of said second pair containing information representing the sum of a processed sum and a processed difference of said first pair of signals; and means, responsive to said second pair of signals, for transmitting said pair substantially as the different asymmetrical sidebands, respectively, of a carrier wave.

12. Apparatus in accordance with claim 11 wherein said first pair of signals is a pair containing left (L) and right (R) stereo information, respectively.

13. Apparatus in accordance with claim 12 wherein said transmitting means includes an independent sideband AM stereo exciter having a pair of stereo signal inputs to which said second pair of signals are coupled, respectively.

14. The method of processing a supplied pair of left (L) and right (R) stereo signals to develop a second pair of signals suitable for application to the stereo signal inputs of an independent sideband (ISB) AM stereo transmitter, thereby resulting in the transmission of an asymmetrical sideband amplitude modulation (AM) stereo signal suitable for reception on an ISB AM stereo receiver, comprising:

deriving from said supplied pair of L and R stereo signals the sum and the difference thereof;

introducing a predetermined phase difference between said sum and difference signals;

modifying the frequency spectrum and amplitude level of said phase shifted sum signal in accordance with predetermined first and second signal transfer characteristics;

modifying the frequency spectrum and amplitude level of said phase shifted difference signal in accordance with a predetermined third signal transfer characteristic;

combining said phase shifted sum and difference signals, after they have been modified in accordance with said second and third signal transfer characteristics, to form a combined signal;

whereby said phase shifted sum signal, after it has been modified in accordance with said first signal transfer characteristic, and said combined signal constitute said second pair of signals.

15. The method of transmitting an asymmetrical sideband amplitude modulation (AM) stereo signal suitable for reception on an independent sideband AM stereo receiver comprising:

deriving from a supplied pair of left (L) and right (R) stereo signals the sum and the difference thereof;

introducing a predetermined phase difference between said sum and difference signals;

modifying the frequency spectrum and amplitude level of said phase shifted sum signal in accordance with predetermined first and second signal transfer characteristics;

modifying the frequency spectrum and amplitude level of said phase shifted difference signal in accordance with a predetermined third signal transfer characteristic;

combining said phase shifted sum and difference signals, after they have been modified in accordance with said second and third signal transfer characteristics, to form a combined signal;

applying to one stereo signal input of an independent sideband (ISB) AM stereo transmitter said phase shifted sum signal after it has been modified in accordance with said first signal transfer characteristic; and apply said combined signal to the other stereo signal input of said ISB AM stereo transmitter.

* * * * *